United States Patent [19]

Glamm

[11] Patent Number: 4,750,337

[45] Date of Patent: Jun. 14, 1988

[54] OIL MANAGEMENT IN A PARALLEL COMPRESSOR ARRANGEMENT

[75] Inventor: Paul R. Glamm, La Crosse, Wis.

[73] Assignee: American Standard Inc., New York, N.Y.

[21] Appl. No.: 107,813

[22] Filed: Oct. 13, 1987

[51] Int. Cl.[4] ..... F25B 43/02

[52] U.S. Cl. ..... 62/468; 62/84; 62/510

[58] Field of Search ..... 62/84, 468, 469, 510

[56] References Cited

U.S. PATENT DOCUMENTS

| | | | |
|---|---|---|---|
| 3,581,519 | 6/1971 | Garrett, Jr. | 62/468 |
| 3,633,377 | 1/1972 | Quick | 62/510 |
| 3,766,745 | 10/1973 | Quick | 62/510 |
| 3,777,509 | 12/1973 | Muench | 62/468 |
| 3,905,202 | 9/1975 | Taft et al. | 62/510 |
| 4,411,141 | 10/1983 | Hara | 62/468 |
| 4,530,215 | 7/1985 | Kramer | 62/468 |
| 4,551,989 | 11/1985 | Lindahl et al. | 62/468 |

*Primary Examiner*—Ronald C. Capossela

*Attorney, Agent, or Firm*—William J. Beres; David L. Polsley; Robert J. Harter

[57] ABSTRACT

A refrigeration system has multiple compressors in a parallel arrangement. The pressures in the shells of operating compressors are maintained equal by the controlled delivery of suction gas and entrained oil to the shells of individual operating compressors in quantities which maintain the pressures therein equal. A valve, directly responsive to compressor shell pressures, occludes the flow of suction gas to the shell of an operating compressor in which the pressure is greater than that found in the shell of another operating compressor so as to equalize the pressures in the compressor shells. The equalizing valve arrangement directs and apportions essentially the entire amount of suction gas to the shells of operating compressors while cutting off the flow of suction gas into the shells of non-operating compressors. By managing the flow of suction gas so as to maintain shell pressures equal in operating compressors, equal amounts of entrained oil are directed to the shells of the operating compressors so as to ensure that no operating compressor becomes starved for oil.

19 Claims, 2 Drawing Sheets

OIL MANAGEMENT IN A PARALLEL COMPRESSOR ARRANGEMENT

BACKGROUND OF THE INVENTION

The present invention relates generally to oil management and oil level equalization in the sumps of parallel, manifolded compressors in a refrigeration system. More specifically, the present invention relates to the maintenance of equal oil levels in the sumps of hermetic compressors in a parallel compressor refrigeration system through the employment of apparatus which insures that equal amounts of suction gas and entrained oil are delivered to the shells of operating compressors by maintaining the pressures in the shells of operating compressors equal.

It is well documented that when low-side compressors are employed in a parallel arrangement in a refrigeration system, the tendency exists for one of the compressors to become starved for lubricating oil. Low-side compressors are those in which suction gas is essentially dumped into the interior of the shell of the compressor from where it is drawn into the motor-compressor housed within the shell.

The hermetic shells of low-side refrigeration compressors house motor-compressor units and generally define lubricating oil sumps at their bottoms. A portion of the motor-compressor lubricating oil, which collects and is stored in such sump areas, becomes entrained in the suction gas drawn into the motor-compressor and travels with the suction gas into, through and out of the motor-compressor. The lubricating oil is carried through the refrigeration system entrained in the system refrigerant and eventually makes its way back to the suction line by which the refrigerant is returned to the parallel compressor arrangement in the system.

When suction gas is returned from the evaporator to the compressors in a parallel compressor refrigeration system it is inevitable that one of the compressors will draw more suction gas, and consequently more entrained lubricating oil, into its shell than will the other compressor or compressors. Over a period of time, and unless otherwise accounted for, at least one of the compressors will become starved for oil and ultimately will fail.

Many oil level equalization schemes for parallel compressor refrigeration systems are known. Such systems may include an oil line leading from a common oil reservoir to the individual sumps of the multiple system compressors as is illustrated in U.S. Pat. Nos. 3,581,519 to Garrett; 3,777,509 to Muench and 4,530,215 to Kramer. Typically, such systems require the use of pumps, eductors or the like to move oil from a common oil storage area to the individual sumps of the individual system compressors. In such systems, the sump pressures of the individual compressors are typically unequal and the oil level in individual compressors is mechanically maintained or assisted.

In other systems, more passive means of equalizing oil levels in the sumps of parallel compressors are employed which do not rely on the accumulation of oil in a common reservoir. Exemplary in this regard are U.S. Pat. Nos. 4,411,141 to Hara and 4,551,989 to Lindahl et al. which employ a lubricant non-return valve and suction piping of predetermined unequal sizes respectively to accomplish more passive and mechanically simple oil management in a manifolded parallel compressor arrangement.

The need continues to exist for a reliable, mechanically uncomplicated and self-regulating arrangement by which the oil levels in parallel compressors in a refrigeration system are maintained at least at a predetermined minimum level.

SUMMARY OF THE INVENTION

It is a primary object of the present invention to provide an improved lubricant management system for a parallel compressor arrangement in a refrigeration system.

Another object of the present invention is to provide an improved lubricant management system which avoids the use of complicated and intricate controls to regulate the level of lubricant in parallel refrigeration system compressors.

Another object of the present invention is to provide an improved lubricant management system for parallel, manifolded refrigeration compressors which avoids the excessive buildup of lubricant in compressors which are not operating, which are operating at less than full capacity or which are of a capacity less than that of another of the operating compressors in a parallel compressor refrigeration system.

Still another object of the present invention is to provide a lubricant management system for parallel compressors which eliminates the need for the collection of lubricant at a single location for apportionment to individual compressors.

Another object of the present invention is to provide a lubricant management arrangement in a parallel compressor refrigeration system which is based upon the apportionment of suction gas and entrained oil directly to the shells of operating compressors.

It is another object of the present invention to provide for improved oil return and management in a parallel refrigeration system compressor arrangement in which the shell pressures of all operating compressors are maintained equal so as to ensure the return of sufficient amounts of suction gas, and therefore lubricating oil, to the shell of each operating compressor.

It is a still further object of the present invention to provide an oil return system for a parallel refrigeration system compressor arrangement in which the shells of operating compressors are maintained at equal pressures by apparatus which is essentially self-regulating in direct response to the pressures in the shell of each operating compressor.

These and other objects of the present invention, which will be appreciated when the following "Description of the Preferred Embodiment" and attached drawing figures are considered, are accomplished by the disposition of a compressor shell pressure equalizing valve in the suction line leading to manifolded, parallel refrigeration system compressors.

The equalizing valve has a first aperture which is in flow communication with the evaporator or evaporators of the refrigeration system. Suction gas enters the barrel of the valve and flows through second and third apertures into suction lines which open, ultimately, one each into the shells of individual manifolded, parallel refrigeration system compressors. Inside of the valve is a spool which moves freely within the valve barrel in in accordance with the pressures found in the shells of a pair of system compressors.

The spool is a dumbbell-type spool with plugs of equal surface areas disposed on the outer ends of a spindle. Suction gas entering the valve flows over the spindle portion of the valve spool and acts concurrently, in a self-cancelling manner, on the inner faces of the plugs. The outer faces of the plugs are exposed, one each, through fourth and fifth valve apertures to the pressure in the shell of a different one of a manifolded pair of compressors. Therefore, if a higher pressure develops in the sump of one of the compressors in a manifolded compressor pair, the higher pressure in the shell of the one compressor acts on one of the outer faces of the valve spool in the pressure equalizing valve to move the spool in the valve barrel.

By causing the spool to move, the flow of suction gas to the sump of the compressor at higher pressure is reduced as the plug having the face exposed to higher pressure moves to occlude the individual suction line which leads from the equalizing valve to the shell of the compressor which is at higher pressure.

During steady-state operation, when the shells of the compressors are at equal pressures, indicating the receipt in each shell of like amounts of suction gas and entrained oil, the valve spool is centered so that the shell of each operating compressor receives the same amount of suction gas and therefore, entrained lubricating oil. If the pressure in the shell of one of the compressors starts to increase, the spool is moved to reduce suction gas flow to the shell of that compressor thereby decreasing the amount of suction gas and entrained oil delivered thereinto so as to re-equalize the pressures between the compressor shells. It is thereby ensured that each compressor shell ultimately receives an adequate amount of suction gas and entrained oil.

The spool will hunt back and forth within the valve barrel to ensure that equal pressures are maintained within the shells of the parallel compressors when both compressors are operating thereby causing each shell to be continuously replenished with lubricating oil.

If one of a pair of manifolded, parallel compressors shuts down, a higher pressure will immediately build up in the shell of the compressor which shuts down since suction gas is no longer being drawn out of that shell by the motor-compressor therein. As a result, the plug in the pressure equalizing valve having a face exposed to the pressure in the shell of the compressor which shuts down, is exposed to the relatively higher pressure in that shell and the spool is urged in a direction which essentially cuts off the flow of suction gas to the shell of the shut-down compressor. As a result, the operating compressor receives essentially all of the suction gas and oil entrained therein from the system evaporator.

When the shut-down motor-compressor next starts, it immediately draws a suction on the shell in which it is disposed, creating a lower pressure therein than is found in the shell of the operating compressor. The valve spool is therefore urged by the now higher pressure in the shell of the operating compressor in a direction which opens the flow of suction gas to the shell of the previously non-operating compressor. The flow of suction gas and oil is therefore quickly restored to the later starting compressor.

Because the pressures in the shells of the manifolded parallel compressors are maintained equal when the compressors are in operation and because of the existence of an oil equalization conduit at the nominal oil levels in the sumps of the manifolded compressors, none of the compressors in the refrigeration system of the present invention becomes starved for lubricating oil when it is in operation.

Further, because the flow of suction gas and entrained oil to the shell of a non-operating compressor is essentially blocked and because the shell of a non-operating compressor is always at a higher pressure than the pressure found in the shell of an operating compressor in the parallel compressor system of the present invention, oil will not tend to be driven into the shell of the non-operating compressor, thereby starving the operating compressor of oil, as has been a common problem in previous systems.

The equalizing valve portion of the refrigeration system of the present invention is capable of being employed in a cascaded fashion so that more than two compressors can be manifolded in a parallel compressor arrangement and so that equal operating pressures are maintained internal of the shells of all of the operating compressors in such a system.

DESCRIPTION OF THE PREFERRED EMBODIMENT

Figure 1:
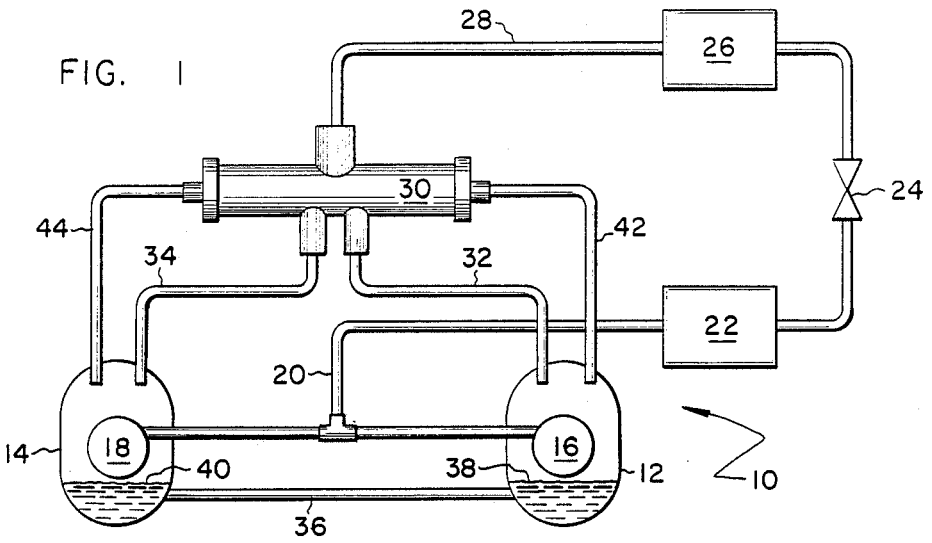
FIG. 1 is a schematic diagram of the refrigeration system of the present invention.

Referring initially to FIG. 1, refrigeration system 10 has a first compressor 12 and a second compressor 14 which are arranged in a manifolded, parallel arrangement. That is, they have a common source of suction gas and they discharge compressed gas to a common discharge line. Internal of compressors 12 and 14 are motor-compressors 16 and 18, respectively. Gas compressed by motor-compressors 16 and 18 is discharged into a common discharge line 20 in system 10 and is delivered therefrom into a condenser 22.

The refrigerant gas delivered to condenser 22 is condensed therein and is delivered through a metering device 24 to an evaporator 26 where it is vaporized in a heat exchange relationship with a source of heat.

Vaporized refrigerant is delivered from evaporator 26 into suction line 28 in which a compressor sump pressure equalizing valve 30 is disposed. As will further be described, suction gas is delivered through valve 30 to the interior of the shells of the compressors 12 and 14 through individual suction lines 32 and 34, respectively. The interiors of the shells of compressors 12 and 14 are connected at a predetermined level above their bottoms by an oil level equalization conduit 36.

Oil level equalization conduit 36 is disposed so as to open into the interiors of the shells of each of compressors 12 and 14 at the nominal required levels 38 and 40 of oil in the sumps of compressors 12 and 14, respectively. Relatively small diameter tubes 42 and 44 are disposed in system 10 so as to open, one each, at a first end into the shells of compressors 12 and 14 and to open at a second end into orifices which communicate with the interior of the barrel of sump pressure equalizing valve 30 as will subsequently be described.

Figure 2:
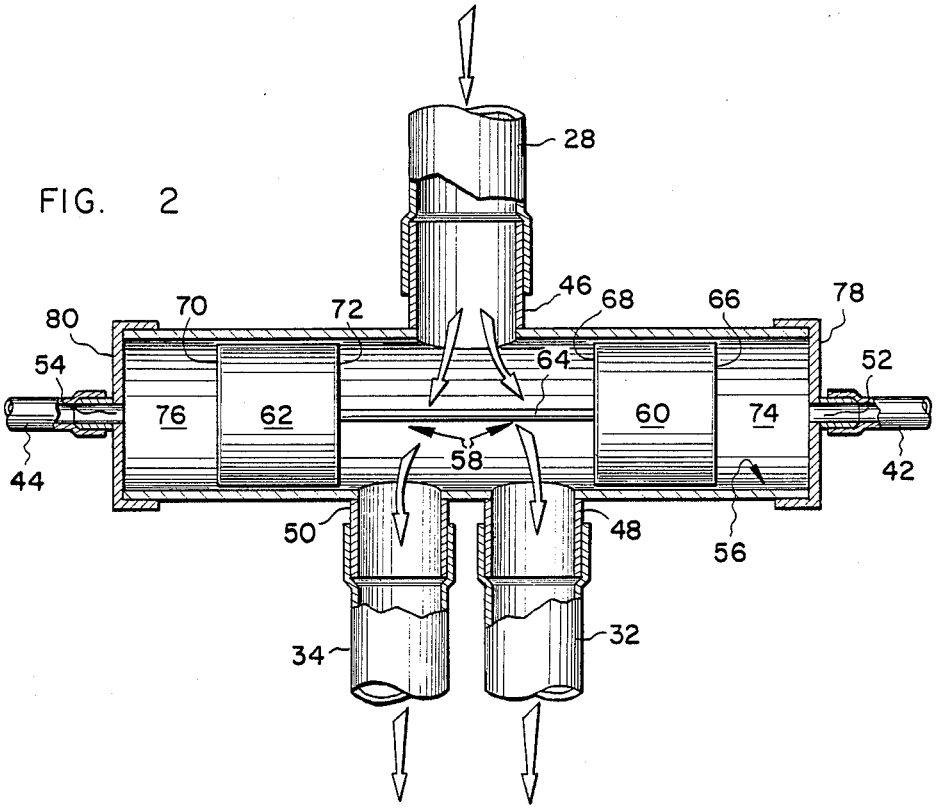
FIG. 2 is a cross-sectional view of the compressor sump pressure equalizing valve portion of the refrigeration system of the present invention illustrating the position of the spool therein when both of the compressors of the system of FIG. 1 are operating and when their shells are at equal pressures.

Referring primarily now to FIG. 2, it will be appreciated that sump pressure equalizing valve 30 has a coupling portion 46 which is attached to suction line 28 of refrigeration system 10. Valve 30 likewise has a first coupling portion 48 through which suction gas is communicated to compressor 12 through individual suction line 32 and a second coupling portion 50 through which suction gas is delivered via individual suction line 34 to compressor 14. Coupling portions 46, 48 and 50 of valve 30 define first, second and third valve apertures and are brazed to suction lines 28, 32 and 34 respectively.

Defined in the ends of valve 30 are fourth and fifth valve apertures 52 and 54. Tubes 42 and 44 are connected to the ends of valve 30 so as to communicate with the interior thereof through apertures 52 and 54 respectively.

Disposed within barrel 56 of valve 30 is a dumbbell type spool 58. Spool 58 is comprised of first and second generally cylindrical plugs 60 and 62 which are connected by a spindle 64. Plugs 60 and 62 are fabricated from a material such as nylon or teflon so as to permit their free and slideable movement within barrel 56 of valve 30.

The length of spindle 64 is such that when spool 58 is centered within the barrel of valve 30 the flow of suction gas through the valve and into coupling portions 48 and 50 of the valve is essentially unobstructed by plugs 60 and 62. As will further be explained, the width of plugs 60 and 62 and the length of barrel 56 of valve 30 are such that when spool 58 is displaced axially of the valve barrel so as to abut an end of the valve, the plug at the end of spool opposite the end of the spool which abuts a valve end essentially occludes, although not completely, portion 48 or 50 of the valve over which it has been displaced.

Plug 60 of spool 58 has a first face 66 which is exposed to the pressure developed in space 74 within the valve barrel. Space 74 communicates with the interior of the shell of compressor 12 through orifice 52 and tube 42. Likewise, face 70 of plug 62 is exposed to the pressure developed in space 76 within the barrel of valve 30. The pressure in space 76 is the same as the pressure found in the shell of compressor 14 since space 76 communicates with the interior of the shell of compressor 14 through tube 44 and aperture 54.

The surface area of face 70 of plug 62 is equal to that of face 66 of plug 60. Because the surface areas of faces 66 and 70 of plugs 60 and 62 respectively are equal, any pressure imbalance between spaces 74 and 76 will result in the slideable movement of spool 58 interior of valve barrel 56 under the influence of the differential pressure.

When system 10 is in steady state operation and the pressures within the shells of compressors 12 and 14 are equal, faces 66 and 70 of spool 58 are exposed to equal pressures and spool 58 is centered within valve 30 so that equal amounts of suction gas and entrained oil are delivered into the shells of compressors 12 and 14 respectively through individual suction lines 32 and 34.

As earlier mentioned, however, no two compressors operate identically, and therefore, one compressor in a manifolded, parallel pair of compressors will tend to draw more suction gas than will the other. Because of this characteristic, higher pressure will tend to develop over a period of time in the shell of one of the parallel compressors.

If, for example, motor-compressor 18 of compressor 14 draws more suction gas than motor-compressor 16 of compressor 12, an elevated pressure will develop within the shell of compressor 12. As the higher pressure begins to develop within the shell of compressor 12 it acts on face 66 of spool 58. The higher pressure in the shell of compressor 12 acts on face 66 of spool 58 so as to displace spool 58 in a direction which is away from the source of higher pressure, i.e. away from orifice 52 and end 78 of valve 30. The displacement of spool 58 away from end 78 of valve 30 and toward end 80 of valve 30 causes plug 60 to move so as to occlude and diminish the flow of suction gas through coupling portion 48 of valve 30 to the shell of compressor 12 which is at an elevated pressure.

The occlusion of coupling portion 48 of valve 30 causes the delivery of suction gas and entrained oil to compressor 12 to be reduced and consequently, the flow of suction gas and entrained oil to compressor 14 to be increased. The decreased suction line flow area to compressor 12 eventually results in a decrease in pressure within the shell of compressor 12.

At such time as the pressure within the shells of compressors 12 and 14 equalize, the continued displacement of spool 58 within valve 30 toward end 80 of the valve barrel ceases. Subsequently, when the pressure within the shell of compressor 14 increases to the extent that it exceeds the the pressure found in the shell of compressor 12, spool 58 is displaced away from end 80 of the valve due to the now existing higher pressure in space 76 as compared to that found in space 74 within the valve.

The flow of suction gas to compressor 12 through coupling portion 48 then increases with such displacement of the spool within valve 30 as the occlusion of coupling portion 32 lessens and the pressures within the shells of the compressors return to an equilibrium condition. At such time as the pressure within the shell of compressor 12 again increases so as to exceed that found in the shell of compressor 14, spool 58 is displaced so as to again occlude the flow of suction gas to motor-compressor 16 in a manner which maintains the pressures in the shells of the compressors essentially equal at all times when both compressors are operating.

Valve 30 is extremely responsive to the development of even a relatively small differential pressure between the shells of compressors 12 and 14. Because spool 58 is free to slideably move within valve 30 and because the suction gas flowing through valve 30 is laiden with oil, spool 58 is immediately responsive to even small disparities in pressure between the shells of the compressors to which it supplies suction gas as there is very little frictional resistance to the movement of the valve spool.

It will be appreciated that as soon as spool 58 moves, the flow of suction gas to the compressor having the higher shell pressure is partially occluded. Spool 58 will typically hunt back and forth within the barrel 56 of valve 30, constantly partially occluding and reopening the flow of suction gas to the shell of the compressor in which higher pressure tends to develop when both compressors are in operation, so that the pressures within the shells of the operating compressors are maintained essentially equal at all times.

Figure 3:
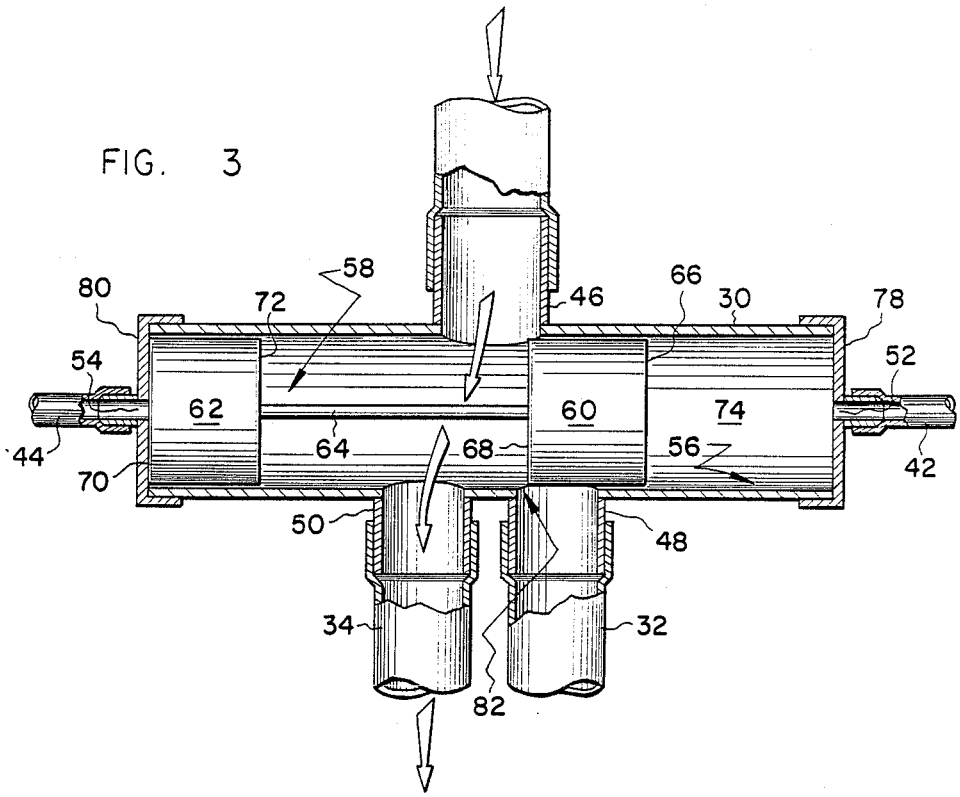
FIG. 3 is a cross-sectional view of the compressor sump pressure equalizing valve portion of the refrigeration system of the present invention illustrating the position of the spool therein when one of the pair of manifolded compressors of the system of FIG. 1 is shut down.

When the load on system 10 is such that the operation of only one of the two manifolded compressors is required, a selected one of the compressors shuts down. Referring now to FIG. 3, it will be assumed that motor-compressor 16 of compressor 12 is designated to be shut down when the load on system 10 is insufficient to warrant the operation of both compressors 12 and 14.

At such time as motor-compressor 16 shuts down, the pressure within the shell of compressor 12 immediately and significantly increases since motor-compressor 16 no longer draws suction gas out of the shell of compressor 12. The development of the higher pressure within the shell of compressor 12 due to the shutdown of motor-compressor 16 is communicated to space 74 of valve 30 through tube 42.

The higher pressure found within the shell of compressor 12 causes spool 58 to be urged away from end 78 of valve 30, as is illustrated in FIG. 3, to the extent that plug 62 is forced into abutment with end 80 of valve 30 and so that plug 60 essentially occludes the flow of suction gas into the shell of now shut down compressor 12.

Because the shell of an operating compressor is always at a lower pressure than that which is found in the shell of a non-operating compressor in a parallel compressor system, spool 58 is maintained in the position illustrated in FIG. 3 as long as motor-compressor 16 is shut down and motor-compressor 18 is operating.

Further, because the pressure in the shell of compressor 12 is higher than that found in the shell of compressor 14, oil is driven out of the sump found within the shell of non-operating compressor 12 through equalization conduit 36 until the level of oil 38 within the shell of compressor 12 drops below the level at which oil level equalization conduit 36 opens into the shell of compressor 12.

Because the flow of suction gas to the shell of compressor 12 is essentially prevented by the displacement of plug 60, which occludes coupling portion 48, essentially all of the suction gas, and the oil entrained therein, flowing through the system is delivered directly into the shell of compressor 14 which in operation.

It will be noted that plug 60 does not completely occlude coupling portion 48 so that the shell of compressor 12 is in limited flow communication with the interior of valve 30 through coupling portion 48. The interior of the shell of compressor 12 therefore remains exposed to the pressure of the suction gas flowing through valve 30 to ensure that a higher pressure is maintained within the shell of non-operating compressor 12 as compared to that found in the shell of operating compressor 14.

At such time as the load on system 10 increases to the point that the non-operating compressor 12 is required to operate, motor-compressor 16 is turned on and immediately draws suction gas out of the shell of compressor 12 and through the restricted flow area 82, found between plug 60 and coupling portion 48 of valve 30, faster than such suction gas can immediately be replaced through area 82. The operation of motor-compressor 16 therefore causes the pressure in the shell of compressor 12 to immediately and rapidly decrease to the point that the pressure within the shell of compressor 12 becomes less than the pressure found in the shell of operating compressor 14.

As soon as the pressure in the shell of compressor 12 drops below that found in the shell of compressor 14, spool 58 is urged, by the higher pressure communicated through orifice 54 of valve 30, away from end 80 of valve 30. The movement of spool 58 toward end 78 of valve 30 results in the movement of plug 60 in a direction which once again opens coupling portion 48 of valve 30 to the flow of suction gas.

The opening of coupling portion 48 to full suction gas flow causes the pressure within the shell of re-started compressor 12 to increase quickly and, as soon as the pressures in spaces 74 and 76 of valve 30 equalize, which will typically be when spool 58 is centered within the barrel 56 of valve 30, the flow of suction gas and entrained oil in equal portions to the shells of compressors 12 and 14 will again have been re-established.

Once again, if motor-compressor 18 is the compressor which draws more suction gas when in operation, the pressure in shell 12 will begin to increase after motor-compressor 16 restarts. As soon as the pressure within the shell of compressor 12 exceeds that found in the shell of compressor 14, spool 58 moves in a manner so as to somewhat occlude the flow of suction gas to the shell of compressor 12 thereby causing the pressure in the shell of compressor 12 to decrease. The shells of compressors 12 and 14 are therefore maintained at essentially equal pressures in operation.

Figure 4:
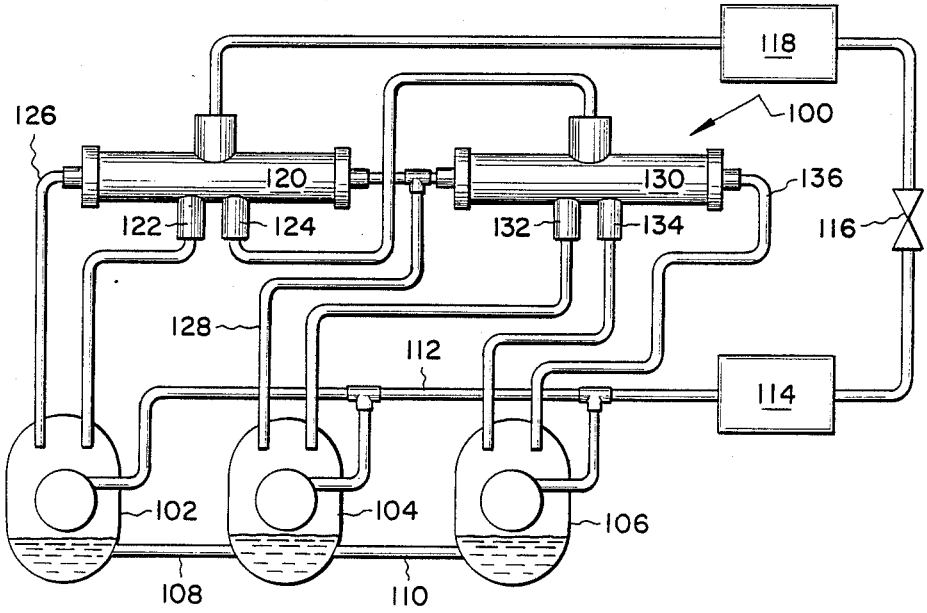
FIG. 4 is a schematic diagram of the refrigeration system of the present invention illustrating the manifolding of more than two parallel compressors and illustrating the cascading of the sump pressure equalizing valve portion of the refrigeration system of the present invention.

Referring now to FIG. 4 it will be appreciated that the refrigeration system of the present invention contemplates the use of more than two compressors in a parallel arrangement in a refrigeration system. Refrigeration system 100 employs three refigeration compressors 102, 104 and 106 the oil sumps of which are connected at a predetermined level by oil equalization conduits 108 and 110.

Compressors 102, 104 and 106 discharge compressed gas into a common discharge line 112. Common discharge line 112 directs the flow of compressed refrigerant into condenser 114 from which condensed refrigerant is directed through an expansion device 116 to an evaporator 118. Suction gas leaving evaporator 118 is directed into equalizing valve 120.

Valve 120, like valve 30 discussed above, has first and second coupling portions 122 and 124 and is in communication with the interior of the shells of compressors 102 and 104 respectively through tubes 126 and 128. Valve 120 apportions suction gas through coupling portion 122 to compressor 102 and through coupling portion 124 to a second equalizing valve 130.

Valve 130 has coupling portions 132 and 134 by which valve 130 apportions suction gas to the shells of compressors 104 and 106 respectively. Valve 130 is exposed to the pressure interior of the shell of compressor 104 through tube 128 at a first end and to the pressure found interior of the shell of compressor 106 through tube 136 at a second end.

It will be appreciated that if all three compressors are operating, the spools interior of valves 120 and 130, which are identical to valve 30 illustrated in FIGS. 2 and 3 and described above, are positioned so as to apportion suction gas and entrained oil to the shells of compressors 102, 104 and 106 in a manner which maintains the pressures within the compressor shells, and therefore the amount of suction gas and entrained oil delivered to those shells, equal.

If compressor 106 is shutdown due to a decrease in the load on system 100, the spool interior of valve 130 is positioned in accordance with the position of the spool illustrated in FIG. 3, since the pressure in the shell of compressor 106 increases and displaces the spool in valve 130 so as to essentially occlude the flow of suction gas into the shell of compressor 106.

In response to the shutdown of compressor 106 and the repositioning of the spool interior of valve 130 the spool interior of valve 120 hunts within the barrel. The spool is positioned so as to maintain shell pressures equal which assures the delivery of equal amounts of suction gas and entrained oil to the shell of compressor 102 and to the shell of compressor 104 through valve 130 and coupling portion 132 thereof.

If the load on system 100 decreases further such that the operation of only a single compressor is required, compressor 104 shuts down. When compressor 104 shuts down the spool interior of valve 120 is positioned in accordance with the position of spool 58 illustrated in FIG. 3 such that essentially the entire flowstream of suction gas through valve 120 is delivered to the shell of operating compressor 102.

It will be appreciated that as the operation of compressors 104 and 106 are again called for, the energization of their motor-compressors causes the spools internal of valves 120 and 130 to be positioned such that suction gas is apportioned to the operating compressors in a manner which ensures that the pressures interior of the shells of the operating compressors are maintained equal. This, in turn, ensures that each operating compressor receives an adequate amount of suction gas and lubricating oil when in operation.

The refrigeration system of the present invention is advantageous from the standpoint that the shell of a non-operating compressor is maintained at a higher pressure than the shell of an operating compressor. Therefore, lubricating oil is not driven from the shell of an operating compressor to the shell of a non-operating compressor through the oil level equalization conduit as has typically occurred in many parallel compressor refrigeration systems. Because the shell of a non-operating compressor is at a higher pressure than the shell of an operating compressor in the parallel refrigeration system of the present invention, the pressure internal of the shell of a non-operating compressor drives oil from the sump of the non-operating compressor through the oil level equalization conduit into the shell of an operating compressor.

However, because the oil level equalization conduit in the parallel compressor refrigeration system of the present invention is positioned to open into the shell of each compressor at a predetermined height above the bottom of the compressor, once the higher pressure in the shell of the non-operating compressor drives oil into the shell of an operating compressor to the extent that the level of the oil in the sump of the non-operating compressor falls below the opening of the oil level equalization conduit, the level of oil in the non-operating compressor stabilizes at a predetermined minimum level. When the non-operating compressor once again starts it therefore has sufficient lubricant to operate until more lubricant is carried into its shell entrained in suction gas.

It will be appreciated that refrigeration systems having more parallel compressors than the three illustrated in FIG. 4 are also contemplated as being within the scope of this invention. The cascading of the equalizing valves taught herein allows for the use of virtually an unlimited number of compressors in a parallel compressor arrangement.

It will further be appreciated that the refrigeration system of the present invention both allows for and contemplates the employment of compressors of unequal capacities in a parallel compressor arrangement. The equalizing valve portion of the present invention will operate, no matter what the capacity of the individual compressors therein, to maintain the shells of the individual compressors at equal pressures when the motor-compressors therein are in operation. The provision of adequate lubricant to each compressor is therefore assured.

Those skilled in the art will contemplate and identify many modifications of the present invention given the teachings herein. Such modifications are within the scope of the present invention which is to be limited only in accordance with the language of the claims which follow.

What is claimed is:

1. An oil management arrangement for parallel compressors in a refrigeration system through which lubricant is carried entrained in system refrigerant, comprising:

a first compressor, said first compressor having a shell at the bottom of which an oil sump is defined;

a second compressor, said second compressor having a shell at the bottom of which an oil sump is defined;

means, connecting the sumps of said first and said second compressors, for equalizing the level of oil therebetween; and means for apportioning vaporized refrigerant gas, in which compressor lubricant is entrained, into the shells of said first and said second compressors, said apportioning means being directly responsive to the pressures internal of the shells of said first and said second compressors so that when both said first and said second compressors are operating said vaporized refrigerant gas and the lubricant entrained therein are adjustably delivered into the shells of said compressors in amounts so as to maintain the pressures in the shells of said compressors essentially equal.

2. The refrigeration system oil management arrangement according to claim 1 wherein said means for apportioning comprises means for delivering a larger amount of vaporized gas and entrained lubricant to the shell of the one of said first and said second compressors which is at a lower pressure when unequal pressures develop between the shells of said compressors.

3. The refrigeration system oil management arrangement according to claim 2 wherein said means for delivering comprises a compressor shell pressure equalizing valve disposed upstream of the shells of said first and said second compressors in said refrigeration system, the entire amount of system refrigerant and all of the oil entrained therein passing into said equalizing valve through a first aperture and said valve having a second and a third aperture in flow communication with said first aperture, said second and said third apertures being in flow communication, one each, with the interiors of the shells of said first and said second compressors.

4. The refrigeration system oil management arrangement according to claim 3 wherein said equalizing valve includes means for occluding the flow of vaporized refrigerant and entrained lubricant to the one of said second and third apertures of said valve which is in flow communication with the shell of the one of said first and said second compressors in which a pressure develops which is higher than is found in the shell of other of said first and said second compressors.

5. The refrigeration system oil management arrangement according to claim 4 wherein said equalizing valve defines a barrel and wherein said means for occluding comprises a spool disposed for slideable movement in said barrel.

6. The refrigeration system oil management arrangement according to claim 5 wherein said spool includes for means for dividing said valve barrel into a first space, which is exclusively in flow communication with the shell of a first of said first and second compressors, a second space, which is exclusively in flow communication with the shell of the other of said first and second compressors, and a third space, which is in flow communication with said first, said second and said third valve apertures.

7. The refrigeration system oil management arrangement according to claim 6 wherein said spool is a dumbbell-type spool having faces exposed, at the opposite ends of said spool, to the pressures in said first and said second compressor shells respectively so that when a differential pressure exists between the shells of said compressors, said spool is urged by said differential pressure to occlude the flow of vaporized refrigerant gas and entrained lubricant into the one of said second and third valve apertures which is in flow communication with the shell of the compressor which is at a higher pressure.

8. The refrigeration system oil management arrangement according to claim 7 wherein said spool includes a first and a second plug connected for cooperative movement, said plugs being dimensioned so that when said spool is centered in said valve barrel the flow of vaporized gas and entrained lubricant into said second and said third valve apertures is essentially unoccluded and so that when said spool is displaced to its maximum extent in said barrel, the one of said second and third apertures which communicates with the shell of the compressor which is at higher pressure is essentially, though not completely, occluded by the one of said first and second plugs having a face exposed to the pressure in the shell of the compressor which is at higher pressure.

9. A parallel compressor refrigeration system comprising:

a first hermetic compressor;

a second hermetic compressor;

an oil level equalization conduit opening into the shells of both said first and said second compressors at a predetermined level;

a discharge line common to both said first and said second compressors through which compressed refrigerant gas and entrained compressor lubricant flows;

a condenser connected to said discharge line;

an evaporator;

means for metering refrigerant and entrained compressor lubricant from said condenser to said evaporator;

a suction line connected to said evaporator for receiving vaporized refrigerant and the compressor lubricant entrained therein; and means for equalizing the pressures in the shells of said first and said second compressors when both of said compressors are operating, said means for equalizing including means positionable in direct response to the development of unequal pressures in the shells of said compressors, for delivering vaporized refrigerant gas and entrained compressor lubricant oil into the shells of said compressors in quantities which consequently cause said shell pressures to equalize so as to ensure the continued supply of adequate lubricant to the shell of each of said first and said second compressors.

10. The refrigeration system according to claim 9 wherein said means for equalizing includes conduit means by which the pressures internal of the shells of said first and said second compressors are individually communicated to said equalizing means.

11. The refrigeration system according to claim 10 wherein said equalizing means comprises a valve having a first aperture through which vaporized gas and entrained compressor lubricant is received from said evaporator, a second aperture through which vaporized gas and entrained compressor lubricant is delivered to the shell of said first compressor, a third aperture through which vaporized gas and entrained compressor lubricant is delivered into the shell of said second compressor, a fourth aperture through which the pressure in the shell of said first compressor is communicated to said valve and a fifth aperture through which the pressure in the shell of said second compressor is communicated to said valve.

12. The refrigeration system according to claim 11 wherein said valve includes means, responsive to the pressures communicated through said fourth and fifth apertures, for occluding the one of said second and third apertures which leads to the one of said first and said second compressors in the shell of which a higher pressure develops.

13. The refrigeration system according to claim 12 wherein said valve defines a barrel and wherein said means for occluding comprises a spool disposed for slideable movement in said barrel.

14. The refrigeration system according to claim 13 wherein said spool comprises a first and a second plug connected for cooperative movement.

15. The refrigeration system according to claim 14 wherein said first plug has a surface in communication with said fourth aperture and wherein said second plug has a surface in communication with said fifth aperture and wherein said first and said second plugs are each exposed to the flow of vaporized gas and entrained compressor lubricant flowing into said first aperture so that the pressure of said flowing gas and entrained lubricant acts on each of said first and said second plugs in a manner which is self cancelling with respect to the positioning of said spool in said valve.

16. The refrigeration system according to claim 15 wherein said first and said second plugs are dimensioned so that when said spool is centered in said valve the flow of vaporized gas and entrained compressor lubricant into said second and said third apertures is essentially unoccluded by said spool and so that when said spool is displaced to its maximum extent in said valve barrel, as a result of the development of a higher pressure in one of said compressors, the one of said second and said third apertures which is in flow communication with the shell of the compressor which is at a higher pressure is essentially, though not completely, occluded by the one of said first and said second plugs having a face exposed to the pressure in the shell of the compressor which is at higher pressure.

17. Apparatus for ensuring the continued delivery of an adequate amount of lubricating oil to the shells of each operating compressor in a parallel, multi-compressor refrigeration system, by controllably maintaining the pressures in the shells of operating compressors equal, and in which compressor lubricant is carried through the refrigeration system entrained in system refrigerant, comprising:

an oil level equalization conduit connecting the shells of said compressors at a predetermined height above the bottom of said compressor shells;

a housing disposed upstream of said compressors in said system, said housing defining a barrel and a first, a second, a third, a fourth and a fifth aperture opening into said barrel, said first aperture being connected to an evaporator in said refrigeration system so as to receive the flow of vaporized refrigerant gas, and the compressor lubricant entrained therein, from said evaporator;

conduit means in flow communication with the interior of the shell of a first of said system compressors and with said second aperture;

conduit means in flow communication with the interior of the shell of a second of said system compressors and said third aperture;

conduit means in flow communication with the interior of the shell of said first of said system compressors and with said fourth aperture;

conduit means in flow communication with the interior of the shell of said second of said system compressors and with said fifth aperture; and means, disposed in said barrel, for dividing said barrel into a first space, a second space and a third space, said first space being in flow communication with said first, said second and said third apertures, said second space being flow communication with said fourth aperture and said third space being in flow communication with said fifth aperture so that when unequal pressures develop in the shells of said first and said second compressors, the pressure in the shell of the compressor which is at the higher of said unequal pressures urges said dividing means within said barrel to occlude the flow of vaporized gas and entrained compressor lubricant to the shell of the compressor in which the higher pressure has developed.

18. The apparatus according to claim 17 wherein said dividing means comprises a spool disposed for slideable movement in said barrel, said spool having a first and a second face of equal surface area, said first face being in flow communication with said fourth aperture and said second face being in flow communication with said fifth aperture so that upon the development of unequal pressures in the shells of said first and said second compressors the pressure in the shell of the compressor which is at higher pressure acts on the face of said spool in which it is flow communication with to move said spool in said barrel.

19. The apparatus according to claim 18 wherein said spool includes a first and a second plug connected for cooperative movement, one of said faces being on said first plug and the other of said faces being on said second plug, said plugs being dimensioned so that when said spool is centered in said barrel the flow of vaporized refrigerant gas and entrained compressor lubricant into said second and said third apertures is essentially unoccluded and so that when said spool is displaced to its maximum extent in said barrel, the flow of vaporized refrigerant and entrained compressor lubricant to the shell of one of said first and said second compressors is essentially, though not completely, occluded.

* * * * *